US012428746B2

(12) United States Patent
Gleissner et al.

(10) Patent No.: US 12,428,746 B2
(45) Date of Patent: Sep. 30, 2025

(54) DISTRIBUTION SYSTEM FOR A PROCESS FLUID FOR CHEMICAL AND/OR ELECTROLYTIC SURFACE TREATMENT OF A SUBSTRATE

(71) Applicant: SEMSYSCO GMBH, Salzburg (AT)

(72) Inventors: Andreas Gleissner, Döbriach (AT); Harald Modl, Radenthein (AT)

(73) Assignee: SEMSYSCO GMBH, Salzburg (AT)

( * ) Notice: Subject to any disclaimer, the term of this patent is extended or adjusted under 35 U.S.C. 154(b) by 489 days.

(21) Appl. No.: 17/780,377

(22) PCT Filed: Nov. 16, 2020

(86) PCT No.: PCT/EP2020/082211
§ 371 (c)(1),
(2) Date: May 26, 2022

(87) PCT Pub. No.: WO2021/104911
PCT Pub. Date: Jun. 3, 2021

(65) Prior Publication Data

US 2023/0008513 A1 Jan. 12, 2023

(30) Foreign Application Priority Data

Nov. 26, 2019 (EP) ..... 19211636

(51) Int. Cl.
*C25D 17/04* (2006.01)
*C25D 17/00* (2006.01)
*C25D 17/06* (2006.01)

(52) U.S. Cl.
CPC ..... *C25D 17/04* (2013.01); *C25D 17/007* (2013.01); *C25D 17/06* (2013.01)

(58) Field of Classification Search
CPC ..... C25D 17/04; C25D 17/007; C25D 17/06; C25D 5/08; C25D 17/002
See application file for complete search history.

(56) References Cited

U.S. PATENT DOCUMENTS 9,303,329 B2 4/2016 Inc.
2013/0001087 A1 1/2013 Asa et al.
(Continued)

FOREIGN PATENT DOCUMENTS

CN 104790022 A 7/2015
CN 106087023 A 11/2016
(Continued)

OTHER PUBLICATIONS

International Search Report and Written Opinion in Application No. PCT/EP2020/082211, mailed on Jan. 22, 2021, 11 pages.
(Continued)

*Primary Examiner* — Ciel P Contreras
(74) *Attorney, Agent, or Firm* — Meunier Carlin & Curfman LLC

(57) ABSTRACT

The present disclosure relates to a distribution system for a process fluid for chemical and/or electrolytic surface treatment of a substrate, a device for chemical and/or electrolytic surface treatment of a substrate in a process fluid, a use of the distribution system, and a method for manufacturing the distribution system. The distribution system comprises: a first distribution body, a substitute body, and a framework. The first distribution body is configured to direct a flow of the process fluid and/or an electrical current to the substrate. The first distribution body and the substitute body are arranged to insert the substrate between them. The framework is configured to mount the first distribution body and the substitute body relative to each other. The framework is further configured to form, together with the first distribution body and the substitute body, a casing surrounding the substrate.

4 Claims, 4 Drawing Sheets

(56) References Cited

U.S. PATENT DOCUMENTS

| | | | | |
|---|---|---|---|---|
| 2015/0129418 | A1* | 5/2015 | Keigler | C25D 21/10 204/237 |
| 2019/0292679 | A1 | 9/2019 | Weinhold | |

FOREIGN PATENT DOCUMENTS

| | | | |
|---|---|---|---|
| DE | 102010033256 | A1 | 2/2012 |
| GB | 2564893 | A | 1/2019 |
| GB | 2564894 | A | 1/2019 |
| JP | 2019-49046 | A | 3/2019 |

OTHER PUBLICATIONS

Office Action issued on May 11, 2024, in Chinese Application No. 202080075243.5, 13 pages.
Invitation to Respond to Written Opinion issued on Feb. 20, 2024, in Singaporean Application No. 11202201748S.
Written Opinion issued on Feb. 20, 2024, in Singaporean Application No. 11202201748S.
Office Action issued on Apr. 22, 2024, in Korean Application No. 10-2022-7012704.
Office Action and English translation thereof issued in corresponding ROC (Taiwan) patent application No. 111113453, issued Mar. 3, 2023, 8 pages.
European Search Report of European Application No. 19211636.6, completed May 15, 2020, 3 pages.
Communication Pursuant to Article 94(3) EPC, issued for European Application No. 19211636.6, dated Jun. 1, 2021, 6 pages.
Extended European Search Report issued on Aug. 28, 2020 in European Application No. 19211636.6, 14 pages.
Communication Pursuant to Article 94(3) EPC, issued for European Application No. 19211636.6, dated Sep. 7, 2021, 5 pages.
Communication Pursuant to Article 94(3) EPC, issued for European Application No. 19211636.6, dated Dec. 9, 2021, 4 pages.
Communication Pursuant to Article 94(3) EPC, issued for European Application No. 19211636.6, dated Apr. 8, 2021, 7 pages.
Written Opinion and Invitation to Respond to Written Opinion issued on Aug. 8, 2024, in Singaporean Patent Application No. 11202201748S.

* cited by examiner

DISTRIBUTION SYSTEM FOR A PROCESS FLUID FOR CHEMICAL AND/OR ELECTROLYTIC SURFACE TREATMENT OF A SUBSTRATE

TECHNICAL FIELD

The present disclosure relates to a distribution system for a process fluid for chemical and/or electrolytic surface treatment of a substrate, a device for chemical and/or electrolytic surface treatment of a substrate in a process fluid, a use of a distribution system, and a manufacturing method for a distribution system for a process fluid configured for chemical and/or electrolytic surface treatment of a substrate.

BACKGROUND

Substrate dimensions of panels for producing printed circuit boards (PCBs) are undergoing significant increases in their dimensions in order to enhance manufacturing efficiency as well as to accommodate large physical size technology requirements. Panels are already reaching single side lengths of significantly more than 1000 mm and in some cases even more than 3000 mm.

The best processing results are achieved today with so called HSP systems, meaning systems containing High Speed Plating technology. In such a system, one or two HSPs together with one or two substrates are immersed into a tank containing an electrolyte and one or several anodes. Within this tank filled with electrolyte, the electrolyte (and with this the current distribution) is directed through the HSP plate(s) towards the substrate surface(s). However, when the panel sizes are reaching larger dimensions, it has been noticed, that significant and varying stray currents are appearing, which are flowing around the HSP(s) from the anode(s) to the substrate (acting as cathode) resulting in unwanted, non-uniform material deposition on the substrate.

These varying stray currents appearing in larger size panel plating systems have been identified to result from the fact that the HSPs are manufactured from non-metallic (plastic) materials, which are usually deforming slightly during the use in processes with variable temperatures. Through the deformation, material gaps between the various components of the plating system can appear and again disappear resulting in unwanted avenues for currents to circumvent the HSP distribution direction. Responsible for this behavior of large size HSP systems are material properties like expansion coefficients, material strengths and deformation stabilities, which cannot be overcome. So, with the current designs and implementations of HSPs in the industry, these stray current and uniformity problems cannot be solved in general.

SUMMARY

Hence, there is a need to provide an improved distribution system for a process fluid for chemical and/or electrolytic surface treatment of large size substrates, which enables in particular highly uniform material deposition.

The problem is solved by the subject-matters of the independent claims, wherein further embodiments are incorporated in the dependent claims. It should be noted that the aspects of the disclosure described in the following apply also to the a distribution system for a process fluid for chemical and/or electrolytic surface treatment of a substrate, a device for chemical and/or electrolytic surface treatment of a substrate in a process fluid, a use and a manufacturing method for a distribution system for a process fluid configured for chemical and/or electrolytic surface treatment of a substrate.

According to the present disclosure, a distribution system for a process fluid configured for chemical and/or electrolytic surface treatment of a substrate is presented. The distribution system for a process fluid comprises a first distribution body, a substitute body, and a framework.

The first distribution body is configured to direct a flow of the process fluid and/or an electrical current to the substrate. The first distribution body and the substitute body are arranged to insert the substrate between them. The framework is configured to mount the first distribution body and the substitute body relative to each other. The framework may comprise at least one, preferably several distribution frame elements. The framework may arranged between the distribution body and the substitute body and determine a distance between them to provide a suitable space for receiving the substrate to be treated.

The framework is further configured to form, together with the first distribution body and the substitute body, a casing surrounding the substrate. In other words, the first distribution body, the substitute body and the framework form together the casing for the substrate. The casing forms a processing or plating cell for chemical and/or electrolytic surface treatment of the substrate. The casing or processing cell can be inserted as an independent unit into a tank containing the process fluid. In other words, the casing is not connected with the tank or releasably attached to the tank when inserted into the tank such that the casing may be separately removed from the tank. Accordingly, the casing including the substrate may be safely transferred and a change of the casing may be facilitated independently of the tank.

The casing ensures an electrical isolation of the distribution system and thereby provides an electrical sealing effect as integral part of the distribution system. The casing thereby provides a greatly improved and very reliable electrical sealing of the distribution system. The electrical sealing avoids current leaks in form of stray currents that could otherwise lead to an unwanted non-uniform material deposition.

The casing allows separating the functions of the processing cell and the tank, which consequently allows overcoming the issues caused by different deformation properties of different materials due to e.g. varying expansion coefficients, material strengths and deformation stabilities. As a result, the distribution system according to the present disclosure can also be manufactured with less strict tolerances and without the need for rework or special adjustments to e.g. the tank, as long as a good and long-lasting electrical sealing is being achieved. Consequently, also large substrates can be processed to achieve high deposition uniformities.

The distribution system according to the present disclosure is suitable to be used with a substrate, which is not limited to a specific size. A size of the framework forming a casing together with the first distribution body and the substitute body may be adjusted with respect to the size of the substrate.

In an embodiment, the distribution system for a process fluid configured for chemical and/or electrolytic surface treatment of a substrate further comprises a tank configured to receive the casing and an anode. The tank may also receive more than one anode. In other words, the tank on the one hand and the casing or plating cell on the other hand are constructed as independent units. The distribution system may further comprise a mounting suspension arranged above the casing and configured to hold the casing in a hanging position. The mounting suspension may also be configured to hold the tank in a hanging position relative to the surrounding. The mounting suspension may also be configured to hold the substrate in a substrate holder in a hanging position in the casing.

Instead of one tank also two chambers may be used. In another embodiment, the distribution system therefore comprises two chambers, each mounted to one side face of the casing, wherein each chamber is configured to receive an anode.

In an embodiment, the tank or the chamber may be suitable to receive an anode with different sizes. In other words, a size of the tank or the chamber may be adjusted with respect to the size of the anode to be inserted therein.

In an embodiment, the substitute body is a second distribution body also configured to direct a flow of the process fluid and/or an electrical current to the substrate. In other words, the distribution system comprises a first distribution body, a second distribution and a framework. The first distribution body and the second distribution body are configured to direct a flow of the process fluid and/or an electrical current to the substrate. The first distribution body and the second distribution are arranged to insert the at least one substrate between them. The framework is configured to mount the first distribution body and the second distribution body relative to each other. The framework is further configured to form, together with the first distribution body and the second distribution body, a casing surrounding the at least one substrate.

In an embodiment, the distribution system for a process fluid further comprises one or more electrical sealing units configured to seal an interface between the framework and the first distribution body as well as an interface between the framework and the substitute body in an electrically insulated manner relative to the surrounding. The one or more sealing units lead to an electrical isolation of the casing and thereby avoids the possibility of stray currents around the distribution body. As a result, the processing uniformity is significantly improved. A sealing unit can be an elongated, elastically deformable element placed at the interfaces in-between the different components where currents are applied and need to be contained as to avoid unwanted stray currents to appear. Examples for sealing units are adequately shaped and sized gaskets like O-rings, lip seals, compression seal fittings, face seals, plug seals, inflatable seals, hydrostatic or hydrodynamic seals, bonded seals, adhesive seals or similar. Electrical sealing can also be achieved by welding the different components together.

In an embodiment, the top surface of the casing is at least partially open to allow a passage of the substrate. As a result, a substrate holder with one or two substrates can be inserted from the top surface through an opening into the casing. The top surface of the casing is at least partially open to the surrounding environment. The casing can then be understood as electrically insulated at the sides and the bottom, but open at the top.

In an embodiment, the framework comprises several separate frame elements to be mounted relative to each other, the first distribution body and the substitute body or the second distribution body. For example, the framework comprises four lateral elements and a bottom element. The separate elements may be glued to each other. In an embodiment, the separate frame elements are releasable mounted to each other, the first distribution body and the substitute body. For example, screws can be used. As a result, the two distribution bodies or a single distribution body and a substitute body can be connected to each other firmly and with high precision.

In an embodiment, the framework is configured to mount the first distribution body and the substitute body or the second distribution body parallel to each other. Also, inclinations relative to each other would be possible.

In an embodiment, the framework is more rigid than the first distribution body and the substitute body or the second distribution body. As a result, the framework is configured to force also initially non-parallel first or second distribution or substitute bodies into a parallel condition. This supports the effort to balance manufacturing tolerances. Also, other conditions besides parallel are possible.

In an embodiment, the framework comprises a distribution frame element comprising at least a process fluid inlet and/or a process fluid outlet. The distribution frame element or fluid distribution plate can be arranged at a lower part of the first or second distribution or substitute bodies. The distribution frame element can be used to form an easy connection to a fluid supply system for the tank.

According to the present disclosure, also a device for chemical and/or electrolytic surface treatment of a substrate in a process fluid is presented. The device for chemical and/or electrolytic surface treatment of a substrate comprises a distribution system as described above and a substrate holder. The substrate holder is configured to hold at least one substrate in the distribution system.

In an embodiment, the first distribution body of the distribution system and the substrate holder are mounted in the same reference system above the process fluid to be inserted. The reference system may be a pre-defined reference position or a portion of the device, to which the first distribution body and the substrate holder are mounted. The reference system may be also an upper portion of the framework, which is positioned above the process fluid.

Preferably, the process fluid and/or the electrical current may be fully filled in the tank and the reference system may be arranged above the process fluid. Even if only 50% or 80% of the tank may be filled with the process fluid, the reference system may be arranged above the process fluid. At any level of the process fluid in the tank, however, the first distribution body and the substrate holder should be completely immersed in the process fluid.

The result is an easy to apply and effective cell levelling to ensure an exact horizontal and vertical alignment of the casing relative to a substrate handling system. As the first distribution body and thereby the casing as well as the substrate holder are fixed at their upper ends, all thermal expansions apply in the same direction, namely in a direction to their lower ends. Further, gravity helps to avoid a buckling of the first or second distribution or substitute bodies and keeps them in a planar shape.

According to the present disclosure, also a manufacturing method for a distribution system for a process fluid for chemical and/or electrolytic surface treatment of a substrate is presented. The manufacturing method for a distribution system for a process fluid for chemical and/or electrolytic surface treatment of a substrate comprises the following steps:

arranging a first distribution body and a substitute body for the substrate to be inserted between them, and mounting the first distribution body and the substitute body relative to each other by means of a framework.

The first distribution body and the substitute body are configured to direct a flow of the process fluid and/or an electrical current to the substrate. The framework is configured to form, together with the first distribution body and the substitute body, a casing surrounding the substrate.

According to the present disclosure, also a use of a system or device as described above for chemically and/or electrochemically processing a substrate and in particular a large substrate is presented. The term "large substrate" can be understood as a substrate with dimensions in a range of 300×300 mm and larger. Preferably, a diagonal or diameter of the substrate is equal to or larger than 350 mm, more preferably 500 mm, even more preferably 800 mm, and still even more preferably 1000 mm.

It shall be understood that the system, the device, the use and the method according to the independent claims have similar and/or identical preferred embodiments, in particular, as defined in the dependent claims. It shall be understood further that a preferred embodiment of the disclosure can also be any combination of the dependent claims with the respective independent claim.

These and other aspects of the present disclosure will become apparent from and be elucidated with reference to the embodiments described hereinafter.

BRIEF DESCRIPTION OF THE DRAWINGS

Exemplary embodiments of the disclosure will be described in the following with reference to the accompanying drawing.

DETAILED DESCRIPTION OF EMBODIMENTS

Figure 1:
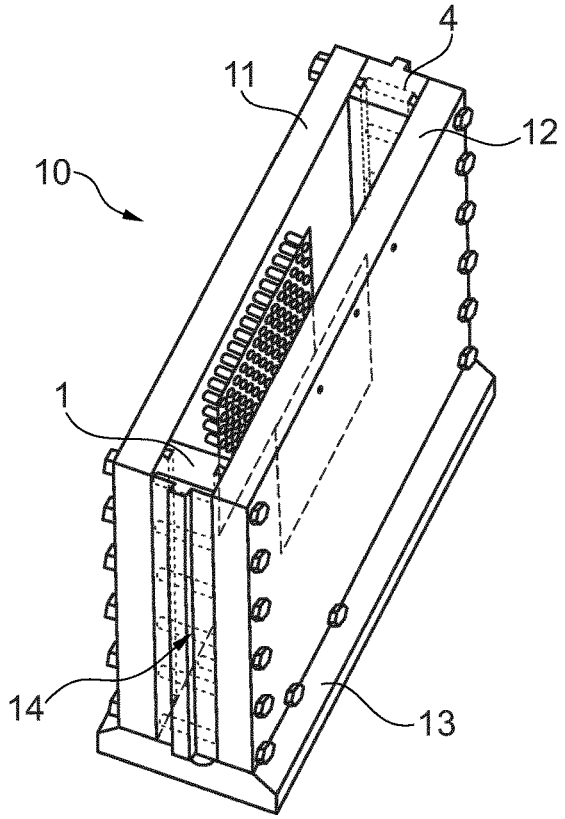
FIG. 1 shows schematically and exemplarily an embodiment of a distribution system for a process fluid for chemical and/or electrolytic surface treatment of a substrate according to the present disclosure.
Figure 2:
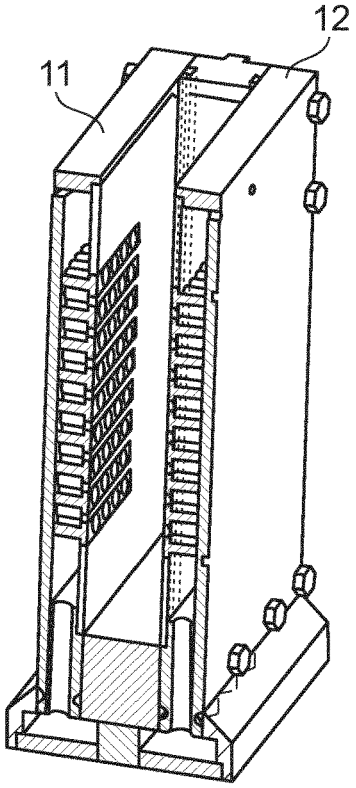
FIG. 2 shows schematically and exemplarily an embodiment of a distribution system for a process fluid according to the present disclosure, when seen in a cross section.

FIG. 1 shows schematically and exemplarily an embodiment of a distribution system 10 for a process fluid for chemical and/or electrolytic surface treatment of a substrate according to the present disclosure. FIG. 2 shows schematically and exemplarily an embodiment of a distribution system 10 for a process fluid according to the present disclosure, when seen in a cross section. The distribution system 10 for a process fluid comprises a first distribution body 11, a second distribution body 12, and a framework 14.

The first distribution body 11 and the second distribution body 12 are configured to direct a flow of the process fluid and/or an electrical current to the substrate. The first distribution and the second distribution body 12 are arranged to insert the substrate between them.

The framework 14 mounts the first distribution body 11 and the second distribution body 12 relative to each other. The framework 14 forms, together with the first distribution body 11 and the second distribution body 12, a casing surrounding the substrate to be inserted. The framework 14 comprises several separate frame elements 1, 4, which are mounted relative to each other, the first distribution body 11 and the second distribution body 12. The framework 14 comprise four lateral elements and a bottom element. The separate elements may be screwed to each other. The framework 14 mounts the first distribution body 11 and the second distribution body 12 parallel to each other.

The top surface of the casing is open to allow a passage of the substrate. A substrate holder 21 (see FIG. 4) with one or two substrates can be inserted from the top surface through an opening into the casing. The top surface of the casing is thereby open to the surrounding environment.

Figure 3:
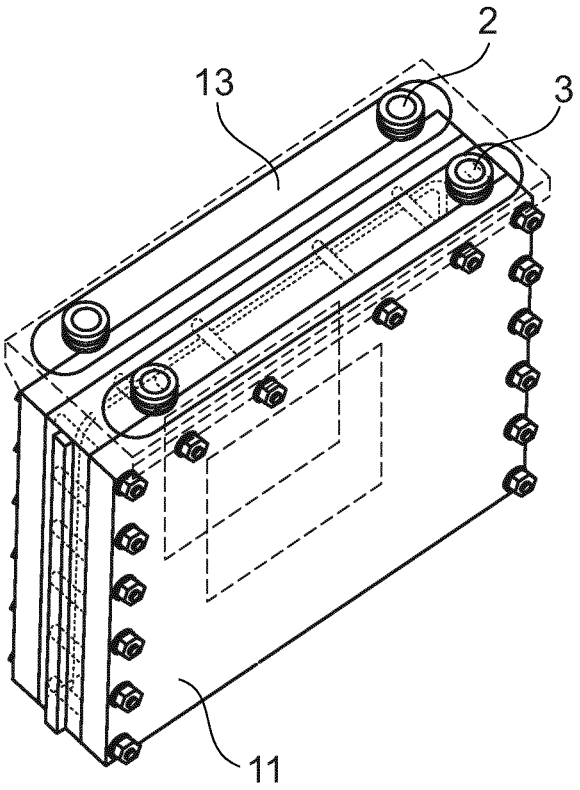
FIG. 3 shows schematically and exemplarily an embodiment of a distribution system for a process fluid according to the present disclosure, when seen from below.

FIG. 3 shows schematically and exemplarily an embodiment of a distribution system 10 for a process fluid according to the present disclosure, when seen from below. As can be seen in FIG. 3, the framework 14 comprises a distribution frame element 13 comprising several process fluid inlets 2 and several process fluid outlets 3. The distribution frame element 13 or fluid distribution plate is arranged at a lower part of the first or second distribution bodies.

In other words, the first distribution body 11, the second distribution body 12 and the framework 14 form together the casing for the substrate. The casing can be inserted as an independent unit into a tank 15 containing the process fluid. This can be seen in FIG. 4.

Figure 4:
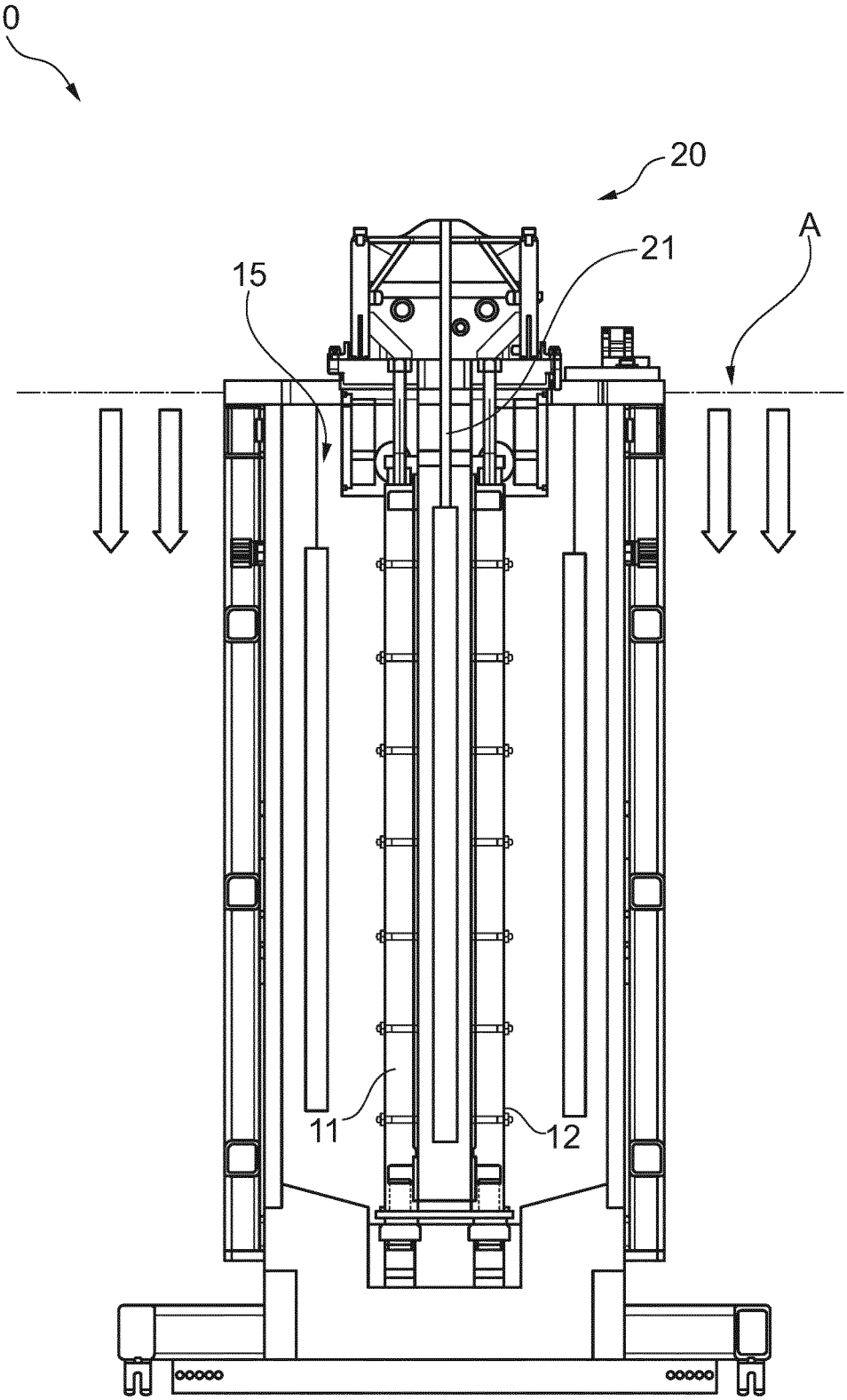
FIG. 4 shows schematically and exemplarily an embodiment of a device for chemical and/or electrolytic surface treatment of a substrate in a process fluid.

FIG. 4 shows schematically and exemplarily an embodiment of a device 20 and a system 10 for chemical and/or electrolytic surface treatment of a substrate in a process fluid. The device 20 comprises the distribution system 10 and a tank 15 to receive the casing and at least one anode. In FIG. 4, two anodes are arranged in the tank 15.

The distribution system 10 further comprises sealing units to seal an interface between the framework 14 and the first distribution body 11 as well as an interface between the framework 14 and the second distribution body 12 in a fluid or liquid tight and electrically insulated manner relative to the surrounding. The sealing units lead to an electrical isolation of the casing.

The framework 14 is more rigid than the first distribution body 11 and the second distribution body 12. As a result, the framework 14 forces also initially non-parallel first or second distribution bodies into a parallel condition.

Figure 5:
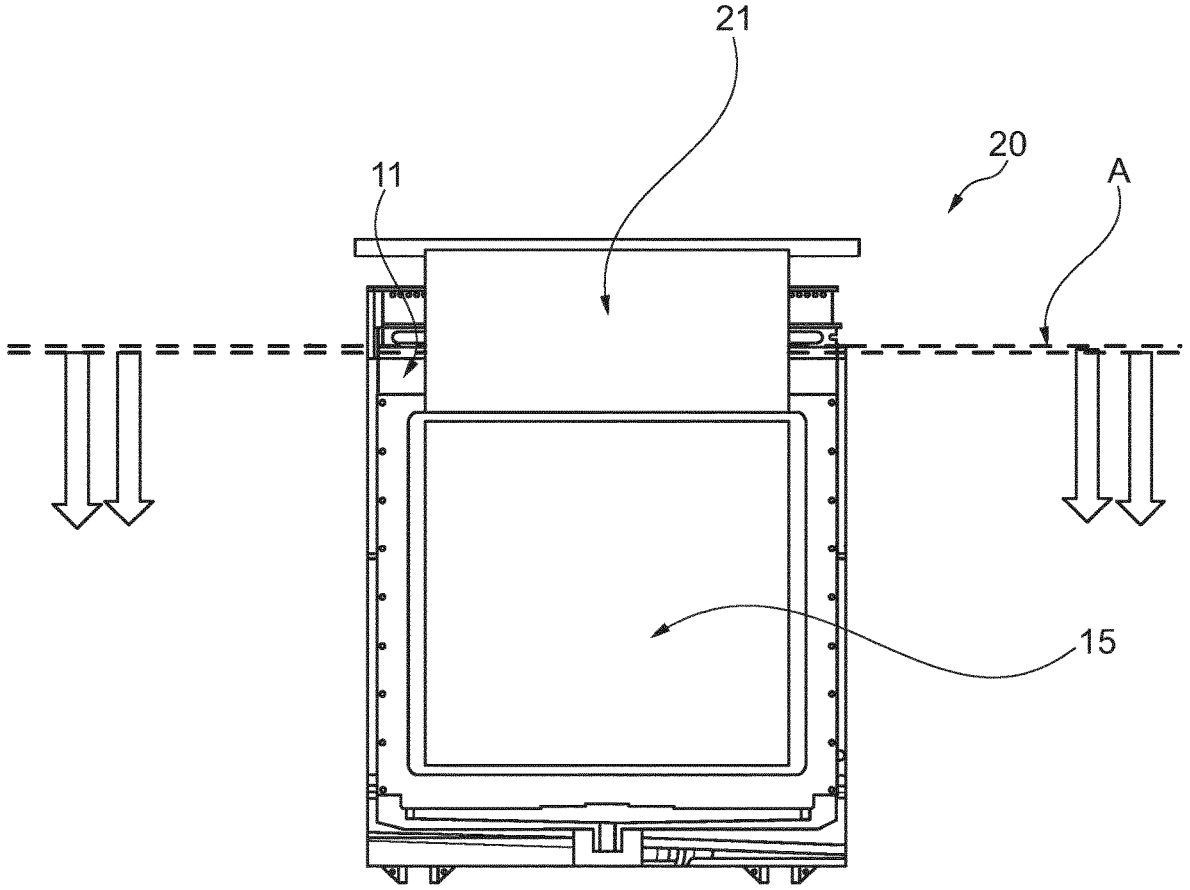
FIG. 5 shows schematically and exemplarily an embodiment of a device for chemical and/or electrolytic surface treatment of a substrate in a process fluid.

FIG. 5 shows schematically and exemplarily an embodiment of a device 20 for chemical and/or electrolytic surface treatment of a substrate in a process fluid. The device 20 for chemical and/or electrolytic surface treatment comprises a distribution system 10 as described above and a substrate holder 21. The substrate holder 21 is configured to hold at least one substrate in the distribution system 10. The casing of the distribution system 10 and the substrate holder 21 are mounted in the same reference system A (see broken lines) above the process fluid. As the first distribution body 11 and thereby the casing as well as the substrate holder 21 are fixed at their upper ends, all thermal expansions apply in the same direction, namely in a direction to their lower ends.

It has to be noted that embodiments of the present disclosure are described with reference to different subject matters. In particular, some embodiments are described with reference to method type claims whereas other embodiments are described with reference to the device type claims. However, a person skilled in the art will gather from the above and the following description that, unless otherwise notified, in addition to any combination of features belonging to one type of subject matter also any combination between features relating to different subject matters is considered to be disclosed with this application. However, all features can be combined providing synergetic effects that are more than the simple summation of the features.

While the present disclosure has been illustrated and described in detail in the drawings and foregoing description, such illustration and description are to be considered illustrative or exemplary and not restrictive. The present disclosure is not limited to the disclosed embodiments. Other variations to the disclosed embodiments can be understood and effected by those skilled in the art in practicing a claimed present disclosure, from a study of the drawings, the disclosure, and the dependent claims.

In the claims, the word "comprising" does not exclude other elements or steps, and the indefinite article "a" or "an" does not exclude a plurality. A single processor or other unit may fulfil the functions of several items re-cited in the claims. The mere fact that certain measures are re-cited in mutually different dependent claims does not indicate that a combination of these measures cannot be used to advantage. Any reference signs in the claims should not be construed as limiting the scope.

Embodiments

1. A distribution system (10) for a process fluid for chemical and/or electrolytic surface treatment of a substrate, comprising:
- a first distribution body (11),
- a substitute body, and
- a framework (14),
- wherein the first distribution body (11) is configured to direct a flow of the process fluid and/or an electrical current to the substrate,
- wherein the first distribution body (11) and the substitute body are arranged to insert the substrate between them,
- wherein the framework (14) is configured to mount the first distribution body (11) and the substitute body relative to each other, and
- wherein the framework (14) is further configured to form, together with the first distribution body (11) and the substitute body, a casing surrounding the substrate.

2. Distribution system (10) according to embodiment 1, further comprising a tank (15) configured to receive the casing and an anode.

3. Distribution system (10) according to embodiment 1, further comprising two chambers, each mounted to one side face of the casing, wherein each chamber is configured to receive an anode.

4. Distribution system (10) according to one of the preceding embodiments, further comprising sealing units configured to seal an interface between the framework (14) and the first distribution body (11) as well as an interface between the framework (14) and the substitute body in an electrically insulated manner relative to the surrounding.

5. Distribution system (10) according to one of the preceding embodiments, wherein a top surface of the casing is at least partially open to allow a passage of the substrate.

6. Distribution system (10) according to one of the preceding embodiments, wherein the framework (14) is configured to mount the first distribution body (11) and the substitute body parallel to each other.

7. Distribution system (10) according to one of the preceding embodiments, wherein the framework (14) comprises several separate frame elements (1, 4) to be mounted relative to each other, the first distribution body (11) and the substitute body.

8. Distribution system (10) according to the preceding embodiment, wherein the separate frame elements (1, 4) are releasable mounted.

9. Distribution system (10) according to one of the preceding embodiments, wherein the framework (14) is more rigid than the first distribution body (11) and the substitute body and thereby configured to force also initially non-parallel first distribution and substitute bodies into a parallel condition.

10. Distribution system (10) according to one of the preceding embodiments, wherein the substitute body is a second distribution body (12) also configured to direct a flow of the process fluid and/or an electrical current to the substrate.

11. Distribution system (10) according to one of the preceding embodiments, wherein the framework (14) comprises a distribution frame element (13) comprising at least a 25 process fluid inlet (2) and/or a process fluid outlet (3).

12. A device (20) for chemical and/or electrolytic surface treatment of a substrate in a process fluid, comprising:
- a distribution system (10) according to one of the proceeding embodiments, and
- a substrate holder (21),
- wherein the substrate holder is configured to hold at least one substrate in the distribution system (10).

13. Device (20) according to the preceding embodiment, wherein a first distribution body (11) of the distribution system (10) and the substrate holder (21) are mounted in the same reference system (A) above the process fluid to be inserted.

14. A manufacturing method for a distribution system (10) for a process fluid for chemical and/or electrolytic surface treatment of a substrate, comprising the following steps:
- arranging a first distribution body (11) and a substitute body for the substrate to be inserted between them, and
- mounting the first distribution body (11) and the substitute body relative to each other by means of a framework (14),
- wherein the first distribution body (11) and the substitute body are configured to direct a flow of the process fluid and/or an electrical current to the substrate, and wherein the framework (14) is configured to form, together with the first distribution body (11) and the substitute body, a casing surrounding the substrate.

15. A use of a system (10) or a device (20) according to one of the embodiments 1 to 13 for chemically processing a substrate and in particular a large substrate.

The invention claimed is:

1. A distribution system for a process fluid for chemical and/or electrolytic surface treatment for a substrate, comprising:
- a first distribution body,
- a substitute body, and
- a framework,
- wherein the first distribution body is configured to direct a flow of the process fluid towards the substrate and configured to direct an electrical current towards the substrate,
- wherein the first distribution body and the substitute body are arranged to insert the substrate between them,
- wherein the framework is configured to mount the first distribution body and the substitute body relative to each other,
- wherein the framework comprises a distribution frame element comprising at least a process fluid inlet and/or a process fluid outlet, the process fluid inlet and the process fluid outlet opening directly to the first distribution body for the process fluid entering inside the first distribution body to flow through the first distribution body and leave the first distribution body from several holes provided on the first distribution body facing the substitute body for the process fluid to be directed towards the substrate, the holes being distributed along a height direction of the first distribution body for providing an equal distribution of the process fluid on the substrate, wherein the framework is further configured to form, together with the first distribution body and the substitute body, a casing surrounding the substrate, and wherein the casing is insertable into the distribution system as an independent unit.

2. The distribution system according to claim 1, further comprising a tank configured to receive the casing and configured to receive an anode.

3. The distribution system according to claim 1, further comprising two chambers, each chamber mounted to one side face of the casing, wherein each chamber is configured to receive an anode.

4. The distribution system according to claim 1, wherein the substitute body is a second distribution body also configured to direct a flow of the process fluid and/or an electrical current to the substrate.

* * * * *